United States Patent [19]

Aimo

[11] Patent Number: 4,924,717

[45] Date of Patent: May 15, 1990

[54] STARTER FOR INTERNAL COMBUSTION ENGINES

[75] Inventor: Vittorio Aimo, Carignano, Italy

[73] Assignee: Efel S.p.A., Turin, Italy

[21] Appl. No.: 323,447

[22] Filed: Mar. 14, 1989

[30] Foreign Application Priority Data

Mar. 18, 1988 [IT] Italy ..... 67243 A/88

[51] Int. Cl.[5] ..... F02N 15/06

[52] U.S. Cl. ..... 74/7 B; 74/7 R; 192/114 R

[58] Field of Search ..... 74/6, 7 R, 7 A, 7 B; 192/114 R

[56] References Cited

U.S. PATENT DOCUMENTS

| | | | |
|---|---|---|---|
| 1,971,740 | 8/1934 | Whitney | 74/7 B |
| 2,345,791 | 4/1944 | Buxton | 74/7 B |
| 2,787,910 | 4/1957 | Sabatini | 74/7 |
| 3,247,727 | 4/1966 | Digby et al. | 74/7 B X |
| 3,656,355 | 4/1972 | Matsumoto | 74/7 B |
| 4,325,265 | 4/1982 | Wakatsuki et al. | 192/114 R X |
| 4,395,923 | 8/1983 | Giometti | 74/7 R |

FOREIGN PATENT DOCUMENTS

| | | | |
|---|---|---|---|
| 717864 | 2/1942 | Fed. Rep. of Germany . | |
| 843175 | 7/1939 | France . | |
| 879003 | 11/1981 | U.S.S.R. | 74/7 B |
| 511289 | 9/1939 | United Kingdom . | |
| 518937 | 3/1940 | United Kingdom | 74/7 B |
| 567440 | 2/1945 | United Kingdom . | |

*Primary Examiner*—Allan D. Herrmann

*Attorney, Agent, or Firm*—Lockwood, Alex, Fitzgibbon & Cummings

[57] ABSTRACT

The starter includes a main shaft (2) which is selectively rotatable and has a threaded portion (4). A movable component (10) is fitted on the shaft and is provided with a pinion (14) and a threaded portion (12) which is coupled with the threaded portion (4) of the shaft (2) in such an arrangement that the rotation of the shaft (2) causes the movement of the movable component (10) towards an advanced position in which the pinion (14) meshes with a ring gear (C) of the internal combustion engine. In order to keep the movable component (10) in its advanced position during the starting operation, the members (13*a*, 13*b*) which act centrifugally are provided and have respective generally-arcuate portions which clamp around a tapered portion (5, 6) of the main shaft when the starter is activated as a result of the centrifugal diverging of the bodies.

28 Claims, 2 Drawing Sheets

STARTER FOR INTERNAL COMBUSTION ENGINES

The present invention relates to starters for internal combustion engines and particularly concerns a starter of the type which has a main shaft which can be rotated selectively and has a threaded portion.

A movable component is fitted on to the main shaft and provided with a pinion which can be rotated by the main shaft so as to act as a starter member. A respective threaded portion is coupled to the threaded portion of the main shaft in an arrangement such that the rotation of the main shaft causes the movement of the movable component towards an advanced position in which the pinion acts as a starter member.

Also included are members which act centrifugally and which, as a result of their diverging movement due to the rotation of the main shaft, can hold the movable component in the advanced position.

DESCRIPTION OF THE RELATED ART

A starter of the type specified above is known, for example from U.S. Pat. No. 4,325,265.

This starter differs from prior art starters (such as those known, for example, from British Pat. No. 511,289, German Pat. No. 717,864, French Pat. No. 843,175 and U.S. Pat. Nos. 2,787,910 and 3,656,355) in that it provides for the use of means which act centrifugally. not for disengaging the pinion from its advanced starting position but for keeping the pinion in that position until the internal combustion engine has safely been started.

The object of the present invention is to provide a starter which is further improved, particularly as regards the reduction of its dimensions (and therefore of its weight) and its structural simplification, which provides cost advantages in the manufacture of the product on an industrial scale.

SUMMARY OF THE INVENTION

According to the present invention, this object is achieved by virtue of a starter of the type specified above and in which the main shaft has a tapered part (usually defined by a shoulder of the shaft itself) which tapers in the direction of movement of the movable component towards its advanced position, and member which act centrifugally include at least one portion which can embrace the main shaft in correspondence with the taper as a result of their diverging movement.

BRIEF DESCRIPTION OF THE DRAWINGS

The invention will now be described, purely by way of non-limiting example, with reference to the appended drawings, in which.

DESCRIPTION OF PREFERRED EMBODIMENTS

Figure 1:
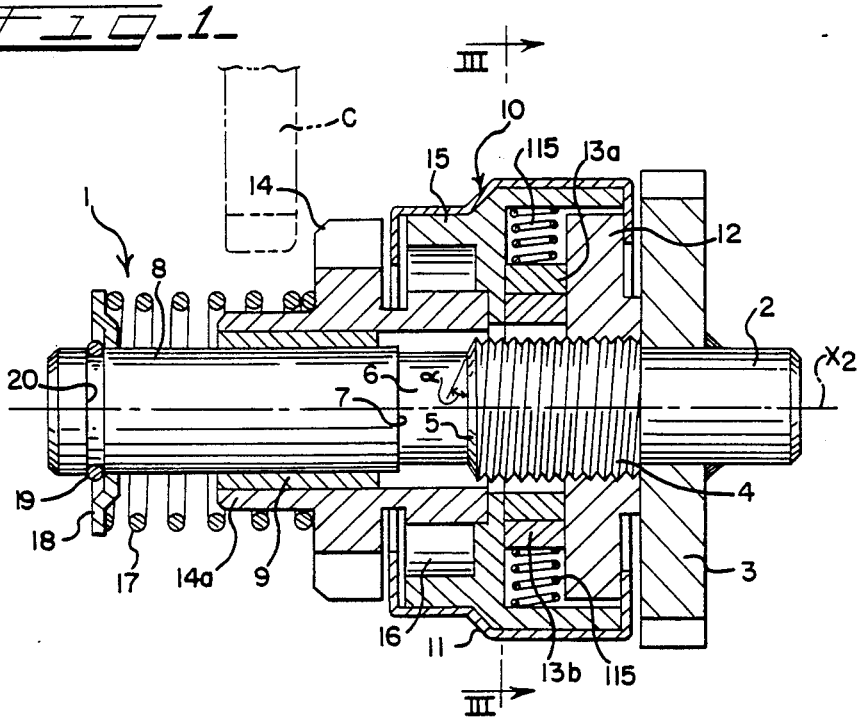
FIGS. 1 and 2 are two longitudinal median sections of a starter according to the invention, shown in two different operating positions.
Figure 2:
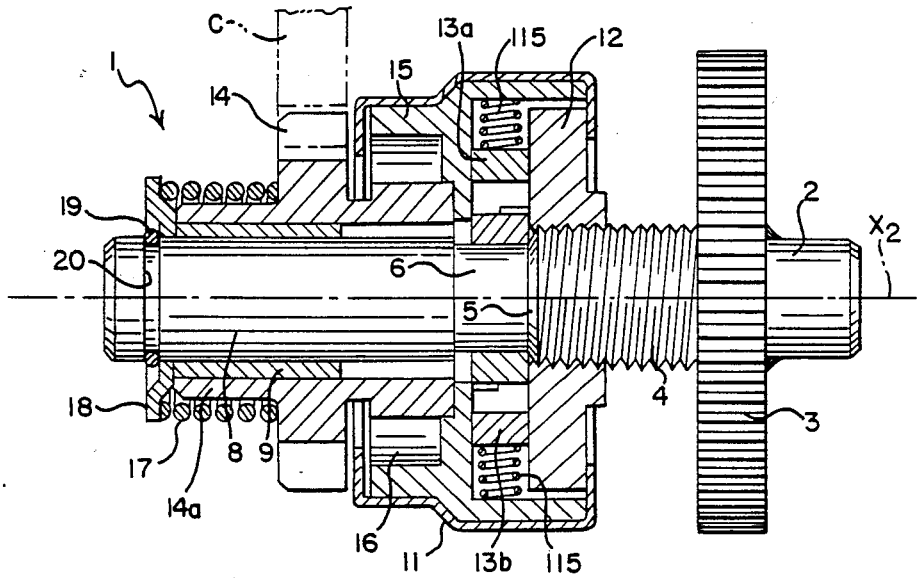

In the drawings, a starter generally indicated 1 is intended for association with an electric starter motor (not illustrated) so as to enable the starting of an internal combustion engine of which the ring gear C keyed to the shaft is partially visible in FIGS. 1 and 2.

The general criteria of operation of the starter 1 must be considered as well known per se, being described inter alia in all the prior art documents referred to above.

The main shaft of the starter 1 is indicated 2 and has a sprocket 3 keyed firmly to one end thereof, for rotation by the electric motor (not illustrated) already referred to above—causing the rotation of the shaft 2 about its axis $X_2$.

Immediately behind the sprocket 3, the shaft 2 has a portion 4 which has a helical thread with several starts.

Immediately downstream of the threaded portion 4, the shaft 2 has a shoulder 5 which constitutes one side of an annular groove 6.

On its side opposite the shoulder 5, the groove 6 is defined by another shoulder 7, downstream of which the shaft 2 continues into a substantially cylindrical portion 8.

A generally-cylindrical, movable component 10 is slidably fitted around the shaft 2 with the interposition of a bush 9 of self-lubricating material which surrounds the cylindrical portion 8.

The component 10 is constituted essentially by a cover or casing 11 of pressed metal which (starting from the end facing towards the sprocket 3) encloses the following elements:

an annular body 12 with internal threading which is complementary to the threading of the portion 4 of the shaft and is fitted on to the latter portion with a general screw-nut-type coupling, two bodies or masses 13*a*, 13*b* which act centrifugally and whose characteristics and function will be described in greater detail below, a pinion 14, which is intended to cooperate with the ring gear C; the pinion 14 is coupled to a sleeve 15 defining the body of the movable component 10 by means of a free-wheel mechanism 16 of a type widely known in the art.

The function of the screw-thread coupling between the toothed portion 4 of the shaft 2 and the internal toothing of the annular body 12 is to cause a movement of the movable component 10 generally (and of the pinion 14 carried thereby) towards an advanced position in which it is meshed with the ring gear C, as shown in FIG. 2, as a result of the rotation of the shaft 2.

This advance of the movable element 10 occurs against a resilient biassing force exerted by a helical spring 17 fitted around an annular appendage 14*a* of the pinion 14, which surrounds the cylindrical portion 8 of the shaft 2. More precisely, the spring 17 acts between the pinion 14 and an annular end member 18 fitted around the end of the cylindrical portion 8 of the shaft 2 and held in position by a resilient ring 19 (or like stop member) snap-engaged in a corresponding groove 20 in the shaft 2.

According to the terminology adopted in the claims which follow the shoulder 5 which is frusto-conical and tapers towards the end of the shaft 2 on which the stop end member 18 is fitted, and the groove 6 as a whole, therefore define—within the shaft 2—a taper in the direction of movement of the movable component 10 towards its advanced, meshed position.

The taper of the shoulder 5 is preferably selected so that the generatrices of the theoretical conic surface defined by the shoulder are at an angle $\alpha$ of approximately 80° to the axis $X_2$ of the shaft 2. Moreover, it is preferable for the working of the groove 6 to be such that its diameter is slightly less than the inner or base diameter of the threading 4.

Figure 3:
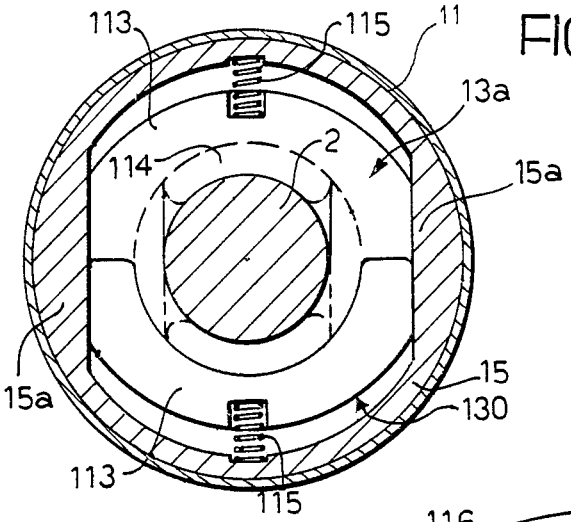
FIG. 3 is a view taken in the plane identified by the line III—III of FIG. 1, and FIGS. 4 and 5 are two perspective views of two elements which can be seen in FIG. 3, shown in the two different positions corresponding to FIG. 1 and FIG. 2.
Figure 4:
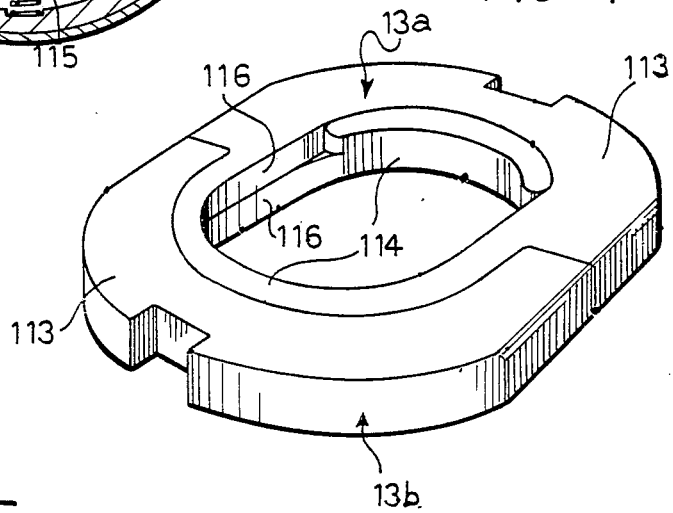
Figure 5:
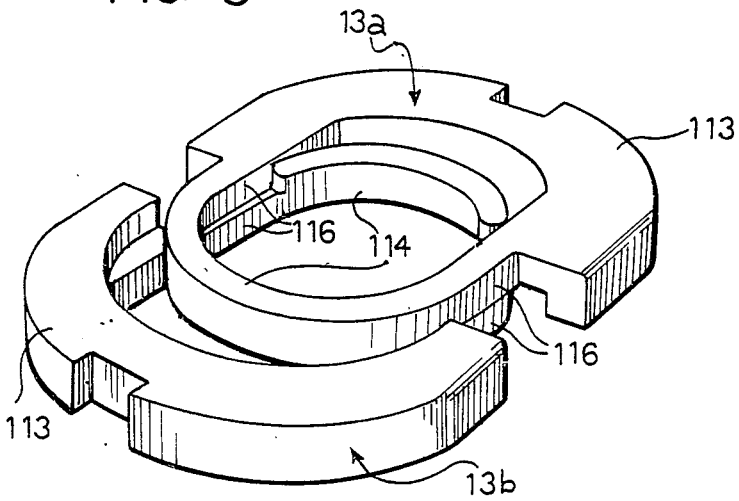

As is best seen in the frontal view of FIG. 3 and in the perspective views of FIGS. 4 and 5, the two centrifugal bodies or masses 13*a* and 13*b* (usually made of metal) are generally annular in shape. They are each constituted essentially by a curved portion 113 which faces the wall of the sleeve 15 (and thus faces away from the shaft 2) and an arcuate portion 114 intended to embrace the shaft 2.

In general, the arcuate portions 114 have respective thinner central sections 116, in correspondence with which the bodies 13*a*, 13*b* are slidably coupled together. The bodies 13*a*, 13*b* are also clearly asymmetrical, as regards the distribution of their weight along their generally annular shape, their centres of gravity being displaced towards the curved portions 113.

The bodies 13*a* and 13*b* are mounted in the sleeve 15 so as to be fitted around the shaft 2. Respective biassing springs 115 which each act between the wall of the sleeve 15 and the curved portion 113 of the body 13*a*, 13*b* facing it, urge the curved portions 113 towards the shaft 2.

The two bodies 13*a* and 13*b* (or more precisely their arcuate portions 114) are slidably coupled so as to be movable between:

a closed (or copenetrating) position—illustrated in FIGS. 1 and 4—in which the respective ends of the two curved portions 113 react against each other and the arcuate portions 114 jointly define a central aperture or orifice whose dimensions correspond substantially (with the tolerance necessary to prevent jamming) with the external diameter of the threaded portion 4 of the shaft 2, and a divergent position (which is that illustrated in FIGS. 2 and 5) in which the two curved portions 113 have moved apart so that the central aperture or orifice jointly defined by the arcuate portions 114 is more closed. In other words the portions 114 are locked in a position in which they are clamped on the shaft 2 in correspondence with the taper defined by the groove 6.

In order to make their relative movement more regular and precise and to avoid jerks and vibrations, the bodies 13*a*, 13*b* are located within the sleeve 15, which is provided internally (see in particular FIG. 3) with two straight, diametrally-opposed, parallel chordal formations 15*a*, which act as sliding and restraining guides for the bodies 13*a* and 13*b*.

In the rest condition, that is when the shaft 2 is not being rotated the starter 1 assumes the position illustrated in FIG. 1.

Under these conditions, the biassing spring 17 urges the pinion 14 (and the movable component 10 as a whole) into the position in which it bears against the drive sprocket 3.

The biassing springs 115 thrust the bodies 13*a*, 13*b* into the position of FIG. 4 in which they are close together so that the threaded section 4 of the shaft 2 extends freely within the central aperture or orifice defined by the arcuate portions 114 without opposing the retraction of the movable component 10.

In order to start the internal combustion engine, the shaft 2 is rotated by the activation of the electric motor which acts on the sprocket 3. The screw-thread coupling between the threaded portion 4 and the annular body 12 as well as causing the rotation of the component 10 and the pinion 14 carried thereby, also drives the advance of the movable component 10 as a whole against the resilient biassing force exerted by the spring 17.

Under these conditions, the pinion 14 is brought into the position in which it meshes with the ring gear C of the internal combustion engine. The pinion 14 thus transmits its movement to the ring gear C, causing the starting of the internal combustion engine.

The advance of the movable component 10 positions the bodies 13*a*, 13*b* in correspondence with the groove 6.

As a result of the rotation of the movable component 10, the curved portions 113 of the bodies 13*a* and 13*b* tend to move apart under the centrifugal effect, overcoming the biassing force of the springs 115 and bringing the bodies 13*a*, 13*b* towards the divergent position shown in FIG. 5.

The central orifice jointly defined by the arcuate portions 114 thus closes up and the portions 114 tighten around the walls of the groove 6 downstream of the shoulder 5.

Under these conditions, the movable component 10 is securely prevented from returning to its rest position as a result of the reaction of the portions 114 against the shoulder 5.

These conditions are maintained firmly during the starting operation, that is, as long as the shaft 2 is rotated.

In particular, the retraction of the movable component 10 (with the disengagement of the pinion 14 from the ring gear C) is safely prevented even under temporary conditions in which—although the internal combustion engine has not yet started permanently—the peripheral speed of the ring gear C is momentarily greater than the peripheral speed of the pinion 14.

The retraction of the movable component 10 with the consequent disengagement of the pinion 14 from the ring gear C—under the biassing action exerted by the spring 17—can occur only when the rate of rotation of the shaft 2 has decreased as a result of the de-activation of the electric motor. Under these conditions, the centrifugal force acting on the bodies 13*a*, 13*b* decreases and can no longer overcome the biassing force exerted by the springs 115.

The presence of the free-wheel mechanism 16 also means that, under these conditions, although the condition in which the pinion 14 is meshed with the ring gear C of the started motor may persist momentarily, the movable component 10 (within which the bodies 13*a*, 13*b* are mounted) is not rotated by the ring C itself.

The conditions shown in FIG. 1 thus tend to be re-established within a short period of time.

The generally-tapered shape of the shoulder 5 (preferably with an angle $\alpha$ of 80°) is intended to facilitate the return of the bodies 13*a*, 13*b* to the rest position shown in FIGS. 1 and 4.

In fact, when the movable component 10 is in the advanced position, the arcuate portions 114 of the two bodies 13*a*, 13*b* against the shoulder 5.

As soon as the component 10 is thrust backwards by the spring 17, the shoulder 5 is inserted like a wedge between the arcuate portions 114, moving them apart and facilitating the movement of the curved portions 113 towards each other under the action of the springs 115.

I claim:

1. In a starter for internal combustion engines, the starter including:

a main shaft which is selectively rotatable, said main shaft having a threaded portion;

a movable assembly fitted on the main shaft and provided with pinion means rotatable with the main shaft, said pinion means being for operatively engaging a rotatable member of an engine, said movable assembly further including a threaded member having threading means for threadedly engaging said threaded portion of the main shaft and for moving said movable assembly, upon rotation of said main shaft, towards an advanced position at which the pinion means operatively engages the rotatable member of the engine; and centrifugally acting means having members which move apart upon rotation of the main shaft, wherein the improvement comprises:

said main shaft has a tapered part which tapers in a direction of movement of the movable assembly towards its said advanced position;

said tapered part is defined by a tapered shoulder of the main shaft, and said tapered part tapers in the direction of movement of said movable assembly towards its said advanced position; and said centrifugally acting means includes at least one profiled portion means for embracing the tapered part of the main shaft as said members of the centrifugally acting means move apart, whereby said movable assembly is held in said advanced position by said centrifugally acting members until the internal combustion engine has been started, after which said movable assembly is allowed to move out of said advanced position.

2. The starter according to claim 1, wherein said tapered shoulder is generally conical.

3. The starter according to claim 2, wherein said tapered shoulder has a generatrix angle of on the order of 80° to the axis of said main shaft.

4. The starter according to claim 1, wherein said tapered part is incorporated in a groove in the main shaft.

5. The starter according to claim 4, wherein said threaded portion of the main shaft has an inside diameter, and wherein said groove has a diameter smaller than said inside diameter of the threaded portion of the main shaft.

6. The starter according to claim 1, wherein said centrifugally acting means includes at least one generally annular body which is fitted around the main shaft.

7. The starter according to claim 1, wherein said centrifugally acting means includes at least two bodies which each have a said profiled portion, and wherein said at least two bodies are coupled for relative sliding movement between:

a first position at which said bodies are substantially copenetrating and at which said at least two bodies jointly define an aperture through which said threaded portion of the main shaft can pass, and a divergent position at which said profiled portions of the at least two bodies are closer together and are clamped onto the main shaft in correspondence with the taper of said tapered part.

8. The starter according to claim 7, wherein each of the at least two bodies includes:

a curved portion of a given thickness, and an arcuate portion which is connected to the curved portion in a generally annular arrangement with a central portion which is thinner than the given thickness and which is slidingly coupled with a homologous central portion of another of the at least two bodies.

9. The starter according to claim 1, wherein resilient means is provided for biasing said centrifugally acting means in a direction opposite movement of said movable assembly towards its said advanced position.

10. The starter according to claim 1, wherein a freewheel mechanism is interposed between said movable assembly and said pinion means.

11. The starter according to claim 1, wherein said movable assembly includes a casing which at least partly encloses:

said threaded member which is coupled with said threaded portion of the main shaft, said centrifugally acting means, and said pinion means.

12. The starter according to claim 11, wherein resilient means are provided for biasing said movable assembly away from its said advanced position.

13. The starter according to claim 1, wherein resilient means are provided for biasing the movable assembly away from its said advanced position.

14. The starter according to claim 13, wherein said resilient biasing means includes a helical spring which is arranged generally around the main shaft, and wherein a stop member is associated with the main shaft for cooperating with an end of the helical spring, and an opposite end of the helical spring bears against the pinion means.

15. The starter according to claim 14, wherein said pinion means has an annular appendage and said helical spring is fitted around the annular appendage.

16. The starter according to claim 1, wherein said tapered part is incorporated in a groove in said main shaft.

17. The starter according to claim 2, wherein said tapered part is incorporated in a groove in said main shaft.

18. The starter according to claim 3, wherein said tapered part is incorporated in a groove in said main shaft.

19. The starter according to claim 16, wherein said threaded portion of the main shaft has an inside diameter, and wherein said groove has a diameter smaller than said inside diameter of the threaded portion of the main shaft.

20. The starter according to claim 17, wherein said threaded portion of the main shaft has an inside diameter, and wherein said groove has a diameter smaller than said inside diameter of the threaded portion of the main shaft.

21. The starter according to claim 18, wherein said threaded portion of the main shaft has an inside diameter, and wherein said groove has a diameter smaller than said inside diameter of the threaded portion of the main shaft.

22. The starter according to claim 1, wherein said centrifugally acting means includes at least one generally annular body which is fitted around said main shaft.

23. The starter according to claim 2, wherein said centrifugally acting means includes at least one generally annular body which is fitted around said main shaft.

24. The starter according to claim 3, wherein said centrifugally acting means includes at least one generally annular body which is fitted around said main shaft.

25. The starter according to claim 4, wherein said centrifugally acting means includes at least one generally annular body which is fitted around said main shaft.

26. The starter according to claim 5, wherein said centrifugally acting means includes at least one generally annular body which is fitted around said main shaft.

27. The starter according to claim 7, wherein each of said at least two bodies is generally annular and is fitted around said main shaft.

28. The starter according to claim 10, wherein said movable assembly includes a casing which at least partially encloses: said threaded member which is coupled with said threaded portion of the main shaft, said centrifugally acting means, and said pinion means.

* * * * *